United States Patent [19]

Miyamae

[11] 4,342,456

[45] Aug. 3, 1982

[54] GOLF PUTTING PRACTICE DEVICE

[76] Inventor: Toshiaki Miyamae, 36-8, Aramoto, Higashi-Osake, Osaka, Japan

[21] Appl. No.: 246,121

[22] Filed: Mar. 20, 1981

[51] Int. Cl.[3] ..... A63B 69/36

[52] U.S. Cl. ..... 273/186 A

[58] Field of Search ..... 273/186 A, 186 RA, 186 R

[56] References Cited

U.S. PATENT DOCUMENTS 4,155,555 5/1979 Fink ..... 273/DIG. 26 X 4,251,077 2/1981 Pelz et al. ..... 273/186 A

FOREIGN PATENT DOCUMENTS 639969 3/1928 France ..... 273/186 A

*Primary Examiner*—George J. Marlo

*Attorney, Agent, or Firm*—Moonray Kojima

[57] ABSTRACT

A device for practicing golf putting strokes includes signal members embedded in the putting surface to detect improper movements of the head of the putting club. Each signal member includes a light source and a coacting sensor which detects the light from the coacting light source when it is reflected from the bottom surface of the putter head. The central bottom surface area of the putter head is covered with a non-reflecting surface, while the remaining bottom surface area of the club head is covered with a reflecting substance such as aluminum.

2 Claims, 4 Drawing Figures

GOLF PUTTING PRACTICE DEVICE

BACKGROUND OF THE INVENTION

The present invention relates to improvements in a putting trainer means for individual practice purposes. In putting-greens it is generally necessary for golf players to roll a golf ball in the lineal direction to a hole by putting the ball with the strength suitable for the rolling movement of the ball. Thus they need to acquire a higher technique for putting a ball, with the putter-head of a putter disposed in properly positioned and angular relation with a supposed lineal direction in which they expect to move the ball.

STATEMENT OF OBJECTS

Accordingly, the present invention has been made, among others, to provide a novel type putting trainer means which can answer the above-mentioned purpose.

The above and other objects and novel features of the invention will more fully appear from the following detailed description when the same is read in connection with the accompanying drawing. It is to be expressely understood, however, that the drawing is for purpose of illustration only and is not intended as a definition of the limits of the invention.

DESCRIPTION OF INVENTION IN RELATION TO DRAWING

Figure 2:
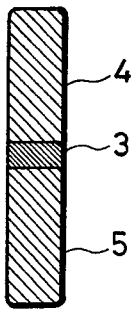
FIG. 2 is a bottom plan view of the putter-head showing a non-reflecting substance provided centrally thereof.
Figure 1:
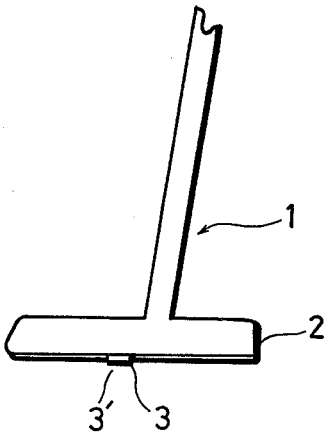
FIG. 1 is a side elevational view of a putting trainer means carried out in accordance with the invention.

Setting forth now in detail a preferred embodiment of the present invention with reference to the accompanying drawing wherein in FIG. 1, numeral 1 generally designates a main putter body having a putter-head 2. A sweet-point 3 or a central bottom surface area of said putter-head 2 is provided with a non-reflecting substance 3' while the other portion 4 of said surface area is covered with a reflecting substance 5 made of aluminium foil, for example.

Figure 3:
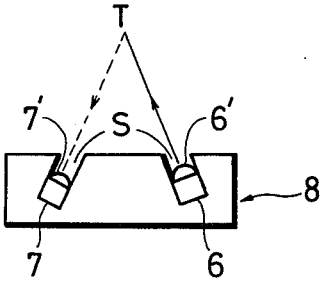
FIG. 3 is a cross sectional view showing a senser means of the invention.
Figure 4:
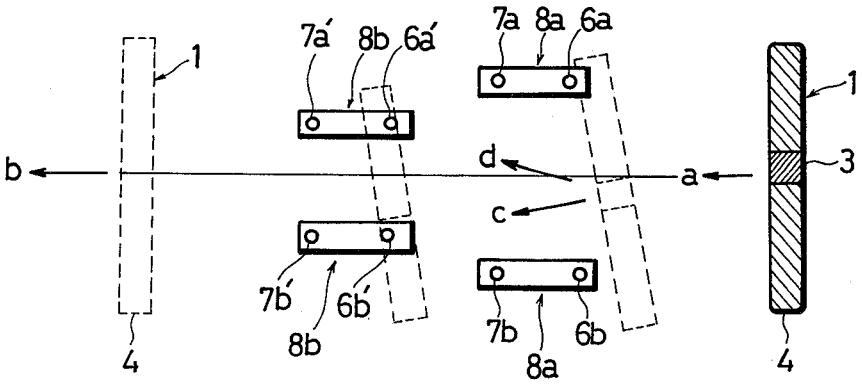
FIG. 4 is a block diagram showing how each of the senser means is disposed.

In FIG. 3 are shown a light or infrared ray emitting element 6 and a light sensing element 7 such as a hot transistor (cds) which are both buried within each of senser means 8 (to be described hereinafter) in inward inclined relation with one another so as to form a to T at a crossing point of supposed extension lines from said element 6 and said element 7. Said senser means 8 comprises a first pair of senser members **8*a* which are disposed opposedly in parallelism at a little greater interval than the width of a sweet-point 3 of the putter 1 in the direction of the arrow a as shown in FIG. 4**.

Incidentally, an outer surface 6' of the light emitting element 6 is either protected within space S of said light emitting element 6 in externally exposed relation or disposed directly externally of the space S. Likewise, an outer surface 7' of the light sensing element 7 is also protected within the space S in externally exposed relation.

The above-mentioned senser means 8 is placed for example on a green area of the garden or fields and a golf player takes a suitable putting position on the area with the putter 1 in his hand. If in this case he could properly puts a ball with the putter 1 along a supposed straight line shown by the arrows a and b, the ball would be exactly holed in a hole (not shown) in the lineal direction of an extension line of the straight line. In other words, said light emitting **6*a*, 6*b* of the senser means 8*a* shown in FIG. 4 are sychronously made to reflect on the reflecing substance 5 of the putter 1 by the lineal movement of the putter 1 in the direction shown by the arrows a and b. In synchronism therewith, the light-sensing elements 7*a*, 7*b* of the senser means 8*a* would catch the reflecting light of the reflection substance 5** thereby sending the light to a computor (not shown) in the form of output signal.

Thus if a display (not shown) adapted to receive this output signal in the form of input signal is previously set to indicate numeral 1 simultaneously the display receives the output signal of the computor, then the light signal sensed by means of said first senser means **8*a* is indicated in the form of numerals 1—1** on the display whereby a player is visually able to confirm how exactly he could putt a golf ball by seeing the numerals indicated on the display.

On the contrary, however, when a player has putted a golf ball with the putter 1 held for example in the direction inclined as shown by the arrow c with respect to the lineal direction of the arrows a and b, then the light sensing element **7*a* catches the light emitted from the light emitting element 6*a* before the element 7*b* can catch the light of the element 6*b*. Thus said element 7*a* sends the light signal to a computor prior to said element 7*b* whereby the display is operated to indicate the putting motion of the putter 1 in the direction shown by the arrow c with respect to the light sensing element 7*a* whereas the element 7*b*** is made to indicate the numeral 0.

Thus the player is able to assume a proper posture by seeing the indication of the display showing in the form of numerals 1–0.

Likewise, if the sweet-point 3 has past in the direction shown by the arrow d, passing in advance above the light emitting element **6*b'* of said second sensor 8*b*, then the light sensing means 7*a'* is left insensitive to the passing motion of the sweet-point 3 whereas the light sensing 7*b'* only directly responses thereto to operate the display to indicate the numerals 0–1, enabling a player to visually confirm to what degree of aberration shown by the arrow d his putting motion of the putter 1** has been made with respect to the straight line shown by the arrow a and b.

While the specification concludes with claims particularly pairing out and distinctly claiming the subject-matter of the invention, it is believed that the invention will be better understood from the following description taken in connection with the accompanying drawing.

What is claimed is:

1. In a putting practice machine comprising a flat surface having a center line on which a golf ball may be placed and over which a golf club may be swung, light sources, sensors of said light, which upon said ball or head of said golf club interrupting the light to a respective sensor will generate a signal indicative of the position of said ball or said head, and means for detecting the signals; the improvement comprising a plurality of pairs of signal members positioned well within said flat surface, each different ones of said pairs being disposed at different distances from said center line, and each signal member consisting essentially of one of said light sources and one of said sensors, said one light source and said one sensor being positioned at angles with respect to one another so that a straight line extending from said light source will intersect a straight line extending from said sensor at a point about where said ball or said golf club head will pass, and wherein further comprising non-reflective means covering the central bottom surface area of said golf club head and reflective means covering the remainder of the bottom area of the golf club head not covered by said non-reflective covering means, and wherein a first pair of said signal members are positioned from each other at a distance substantially wider than the width of said non-reflective covering on said golf club head, and an adjacent second pair of said signal means are positioned from each other at a distance slightly wider than the width of said non-reflective covering of said golf club head, whereby movement of the central bottom surface area of said golf club head off the center line will pass over different ones of said first and second sets of signal members.

2. The putting trainer means, as set forth in claim 1, wherein said reflecting substance is made of aluminium foil.

* * * * *